United States Patent [19]

Densmore et al.

[11] Patent Number: 4,509,439

[45] Date of Patent: Apr. 9, 1985

[54] CLAMP INSERT FOR TUFTING ELEMENTS IN NARROW GAUGE TUFTING MACHINE

[75] Inventors: John C. Densmore, Dalton, Ga.; Charles W. Watkins, Ooltewah, Tenn.

[73] Assignee: Tuftco Corporation, Chattanooga, Tenn.

[21] Appl. No.: 537,598

[22] Filed: Sep. 30, 1983

[51] Int. Cl.[3] ..... D05C 15/00

[52] U.S. Cl. ..... 112/79 R

[58] Field of Search ..... 112/79 R

[56] References Cited

U.S. PATENT DOCUMENTS

| | | | |
|---|---|---|---|
| 4,138,956 | 2/1979 | Parsons | 112/79 R |
| 4,157,690 | 6/1979 | Lund et al. | 112/79 R |
| 4,217,837 | 8/1980 | Beasley et al. | 112/79 R |
| 4,384,538 | 5/1983 | Slattery | 112/79 R |
| 4,397,249 | 8/1983 | Slattery | 112/79 R |
| 4,429,648 | 2/1984 | Slattery | 112/79 R |
| 4,448,137 | 3/1984 | Curtis et al. | 112/79 R |

*Primary Examiner*—Ronald Feldbaum

*Attorney, Agent, or Firm*—Harrington A. Lackey

[57] ABSTRACT

A modular clamping apparatus for a multiple-needle tufting machine including a modular elongated bar, preferably made of solid material, and including an elongated recess opening through the face of the bar. Elongated gauge bars or members having longitudinally spaced gauge slots opening through one side of, and at least one edge of the gauge bar, are inserted within the recess for receiving the shank portions of tufting elements, in operative position. A plurality of T-shaped clamp members each having an elongated divider member and an enlarged flange head along one edge of the divider member, are inserted in operative position within corresponding gauge slots for supporting a pair of the tufting elements within each gauge slot. The clamp members are secured tightly against the tufting elements by set screws extending through the adjacent surface of the recess and against the clamp flange of the clamp member to force the clamp member and the tufting elements against the opposing wall of the gauge bar.

The clamping apparatus made in accordance with this invention is adapted to be utilized in a recessed hook bar for securing multiple looper hooks on a narrow gauge, or in a modified form in cooperation with a recessed needle bar to hold multiple needles in a narrow gauge.

9 Claims, 9 Drawing Figures

CLAMP INSERT FOR TUFTING ELEMENTS IN NARROW GAUGE TUFTING MACHINE

BACKGROUND OF THE INVENTION

This invention relates to a multiple-needle tufting machine, and more particularly to a clamp insert for tufting elements in a narrow gauge tufting machine.

The conventional hook bars for multiple-needle tufting machines are long bars extending transversely of the machine below the needles and the base fabric. A conventional cut-pile hook bar has deeply elongated slots formed through its bottom face and uniformly spaced for receiving the hooks which cooperate with the needles to form loops in the yarns carried by the needle. For a narrow gauge, multiple-needle tufting machine, the looper slots in the hook bar must be formed close together. The proximity of the spacing of the looper slots is limited by the thinness of the walls between the slots. Conventional loopers or hooks are held in their respective slots by individual set screws which are threaded into each slot and engage the opposed walls or lands of the slots. Thus, the thinness of the walls is further limited by the diameters of the set screws. Moreover, the threaded movement of the set screws tends to expand and warp the slot walls or lands.

One solution to spacing the looper slots closer together in a narrow gauge tufting machine is disclosed in the prior U.S. Pat. No. 3,635,177, issued Jan. 18, 1972 to Larry P. Gable et al for NARROW GAUGE HOOK BAR FOR TUFTING MACHINE. The Gable patent discloses a hook bar having uniformly spaced, but staggered, looper slots formed alternately in the front and rear faces of the hook bar. Thus, the staggered front and rear slots receive two transverse rows of staggered hooks or loopers for cooperation with corresponding staggered needles. However, the hook bar disclosed in the Gable patent was primarily designed for a looper apparatus for forming narrow gauge loop pile.

Another method of spacing the hook slots closer together in a narrow gauge tufting machine is disclosed in U.S. Pat. No. 4,067,270 of HOYT E. SHORT for "NARROW GAUGE CUT PILE TUFTING APPARATUS", in which the needles are staggered and the loopers are made quite thin and flexible for bending and veering around each of the corresponding staggered needles.

A further solution for spacing loopers and hook slots closer together in a narrow gauge machine is disclosed in U.S. Pat. No. 4,158,399 of HOYT E. SHORT, issued June 19, 1979, for "NARROW GAUGE CUT PILE LOOPER APPARATUS." In this narrow gauge cut-pile tufting machine, the needles are staggered and the slots are formed in the front and rear faces of the hook bar. However, the slots are designed to extend along the top of the hook bar to receive and reinforce the elongated body portions of the specially constructed looper hooks.

Another type of hook bar or looper apparatus for mounting a plurality of looper hooks close together in order to provide a more narrow gauge for multiple-needle tufting machines, is disclosed in U.S. Pat. No. 4,217,837, of Max M. Beasley et al, issued Aug. 19, 1980, for "FINE GAUGE LOOPER APPARATUS FOR IN-LINE TUFTING MACHINE." In this looper apparatus, the hook slots are formed in an insert bar received in the front face of the hook bar, and the looper hooks are held in position by a plurality of clamp members threadedly secured to the hook block and against the front body portions of the looper hooks. The hook bars are made in the form of elongated modules which are mounted end-to-end and each of the clamp members is adapted to secure a limited number of hooks upon the hook bar module.

In recent times, a plurality of thin hooks have been mounted securely and precisely in a hook bar by casting the metal forming the hook bar around the pre-set hooks. However, although strength, rigidity, and precision are attained, nevertheless, an entire cast module of hooks must be discarded if only a single hook becomes defective.

Modular hook bars including gauge inserts for receiving the loop hooks are disclosed in the co-pending application of Kenneth C. Curtis, et al, Ser. No. 447,974, filed Jan. 26, 1983, for "MODULAR HOOK BAR WITH GAUGE INSERT FOR TUFTING MACHINE." This application is assigned to TUFTCO CORPORATION, the same assignee of the instant application. Even though the above hook bar structure with the gauge inserts operates advantageously, nevertheless, each looper hook is still retained in position in its gauge insert by a set screw. There must be one set screw for each loop hook. Thus, the fineness of the gauge is limited to a certain extent by the thickness or diameter of each set screw. Moreover, the fineness of the gauge is also limited by the number and thickness of the individual slots, each of which receives a separate looper hook.

Conventional needle bars for multiple needle tufting machines are long, continuous, solid bars extending transversely of the machine above the base fabric for the entire width of the fabric to be tufted. A conventional needle bar includes a plurality of needle holes extending vertically through the needle bar and desirably parallel to each other, uniformly spaced at the desired needle gauge. Each needle is inserted through the needle hole in the bottom of the needle bar so that each needle extends substantially the full height, if not the full height, of the needle bar. The needles are secured in position in their respective needle holes by transverse set screws.

The conventional needle bar has always been of one of the most difficult parts of a tufting machine to manufacture, since the numerous needle holes must be drilled very accurately in the long needle bar. It is extremely difficult to control the path of the drill bit through a needle bar which is usually $\frac{7}{8}''$ in depth or height. In the drilling operation, the drill bit often "leads off" in one direction or another at an angle to the vertical. Accordingly, such angular drill holes through the needle bar will not be parallel to each other. Therefore, the elongated needles extending through the angular needle holes would be "off gauge" where the needle holes are not drilled in truly vertical paths. The longer the needle, therefore, the greater the gauge error.

The "lead off" of the drilling paths for each needle hole may be caused by various factors. A drill bit which is not accurately ground, or a drill bit being forced too rapidly into the metal of the needle bar, or a drill bit striking the more dense or harder portion of the metal in the needle bar, can cause the drill bit to deflect from its truly vertical course.

Once the drilling of the conventional needle bar has commenced, it is not possible to determine the path of the drill bit until it emerges from the opposite side of the needle bar. In a multiple needle tufting machine having several hundred needles, the gauge errors between the needles caused by the inaccurate drilling of the needle holes can create considerable problems.

Not only does the drilling of the needle holes involve maintaining accurate control of the drilling paths of the drill bits, but occasionally a drill bit will break off in the drilled needle hole, and the broken drill bit cannot be removed without damaging the needle bar.

All of the above problems in the drilling of the needle holes can result in a needle bar which cannot be used and which must be discarded or scrapped.

Normally, it takes approximately 40 man-hours to drill all of the required needle holes in a conventional needle bar of a multiple needle tufting machine.

Some of the above problems have been overcome by a segmental needle bar, such as that disclosed in the co-pending patent application of JERRY T. GREEN et al, Ser. No. 464,410, filed Feb. 7, 1983, for "SEGMENTAL NEEDLE BAR FOR MULTIPLE NEEDLE TUFTING MACHINE", assigned to the same assignee, TUFTCO CORPORATION. However, in the above-described segmental needle bar, there must be one set screw for each needle.

SUMMARY OF THE INVENTION

It is therefore an object of this invention to provide in a multiple-needle tufting machine an improved clamping mechanism for securing tufting elements, such as looper hooks and needles within their respective hook bar and needle bar, which will permit a narrow needle gauge, as fine as 1/16 of an inch (0.0625 inches), a gauge, which it is believed has not been previously achieved.

The clamp mechanism contemplated by this invention is utilized in combination with a slotted gauge insert, which permits holding two or more tufting elements in a single slot with a single set screw. Thus, only one set screw for each two hooks or two needles is required. Furthermore, a clamp mechanism made in accordance with this invention is capable of being utilized, with slight modification, either for holding looper hooks in a hook bar and/or needles in a needle bar. The structure and function of the clamp mechanism for both the looper hook and the needle is substantially the same.

More specifically, the hook bar or needle bar is made of elongated solid bar stock having an elongated recess opening through one face thereof. A gauge member having a plurality of longitudinally spaced slots is received within the elongated slot of the needle bar or hook bar. Each slot within the gauge member is large enough to receive two tufting elements, that is two looper hook shanks or two needle shanks together with a T-shaped clamp member having a divider wall or stem inserted into the gauge slot between the tufting elements. A set screw threaded through one surface or wall of the elongated bar, extends into the recess and bears against the head of the T-shaped clamp member to secure the pair of tufting elements within their corresponding slot.

By virtue of the above-described construction, the device is readily adaptable to receive and hold the tufting elements on a very fine or narrow gauge with ½ the number of receiving slots and ½ the number of set screws normally utilized for retaining hooks and needles in their respective hook bars and needle bars.

In the hook bar, the recess opens forward to receive the slotted gauge member, looper hooks, and clamp members. The elongated recess in the needle bar opens downward to receive the slotted gauge member, needles, and clamp members.

DESCRIPTION OF THE PREFERRED EMBODIMENTS

Figures 1, 2, 3, 4:
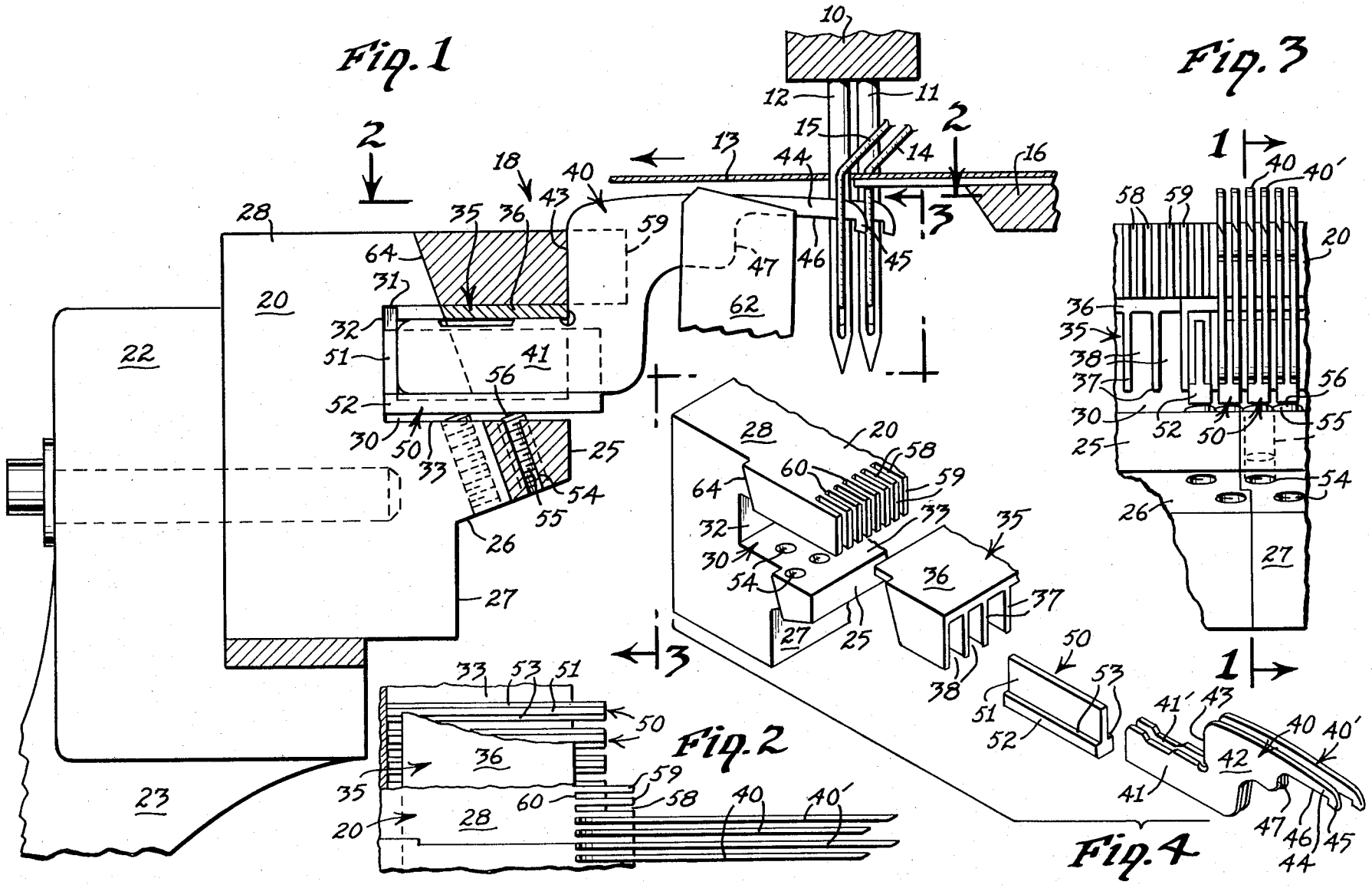
FIG. 1 is a fragmentary sectional elevation taken along the line 1—1 of FIG. 3, longitudinally through a portion of a narrow gauge, staggered-needle tufting machine, incorporating a cut-pile looper apparatus made in accordance with this invention, and disclosing the needles and looper hooks in operative loop-forming positions.
FIG. 2 is a fragmentary top plan view of the looper apparatus, taken along the line 2—2 of FIG. 1, with portions broken away.
FIG. 3 is a fragmentary front elevation of the looper apparatus, taken along the line 3—3 of FIG. 1, with portions broken away and with the knives removed.
FIG. 4 is a fragmentary, top front perspective, exploded view of the looper apparatus, with the parts disassembled.
Figures 5, 6, 7, 8, 9:
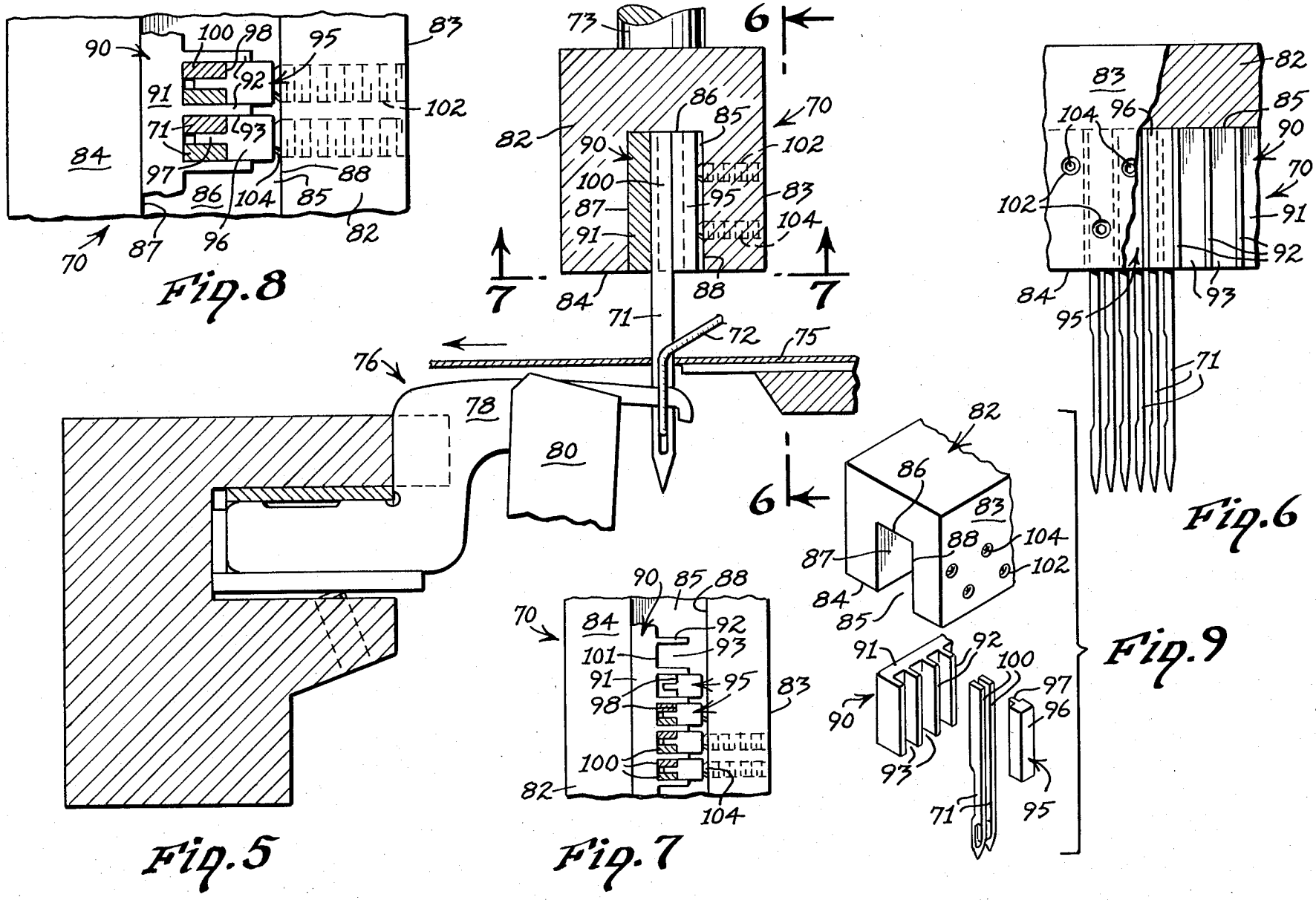
FIG. 5 is a fragmentary sectional elevation, similar to FIG. 1, but disclosing a modified form of the clamping mechanism utilized in combination with the needle bar.
FIG. 6 is a fragmentary front elevation of the needle bar disclosed in FIG. 5, with portions broken away.
FIG. 7 is a fragmentary bottom plan section taken along the line 7—7 of FIG. 5, with portions broken away.
FIG. 8 is an enlarged fragmentary bottom plan section, similar to FIG. 7.
FIG. 9 is a fragmentary top front perspective, exploded view of the needle bar assembly, with the parts disassembled.

Referring now to the drawings in more detail, FIG. 1 discloses a transverse needle bar 10 in a conventional multiple-needle tufting machine supporting a first row of uniformly spaced front needles 11 and a second row of uniformly spaced rear needles 12 offset preferably mid-way between the front needles 11, to provide a uniform, narrow gauge, staggered needle tufting machine. The needle bar 10 is vertically reciprocated by conventional means, not shown, to cause the front and rear needles 11 and 12 to move between an upper position (not shown) above the base fabric 13 to a lower position (FIG. 1) penetrating the base fabric 13, so that the needles will then carry yarns 14 and 15 through the base fabric 13 to form loops of tufting therein. The base fabric 13 is supported upon a needle plate 16 for movement, by means not shown, in the direction of the arrow in FIG. 1, that is longitudinally from front-to-rear through the machine.

The looper apparatus 18 which cooperates with the needles 11 and 12 includes a transverse hook bar 20 supported upon a plurality of transversely spaced brackets 22 fixed to corresponding rocker arms 23 journaled on a rock shaft, not shown, and driven by conventional means, not shown, connected to the rocker arm 23 for limited reciprocable movement in synchronism with the reciprocable movement of the needles 11 and 12. The hook bar 20 has an upper portion and a lower portion, and an upper front face 25, a lower angular outer surface 26 and a lower face surface 27. The hook bar 20 also includes a top surface 28.

Formed in the solid metal hook bar 20 is an elongated, transversely extending recess 30 which opens forward through the upper face 25, and is open in the transverse direction of the recess 30, but is otherwise enclosed to form the top inner surface 31, rear inner surface 32, and bottom inner surface 33.

Received within the recess 30 is an elongated, transversely extending, gauge member or gauge bar 35 comprising an elongated top wall 36 having a top bearing surface, and from which depend a plurality of uniformly transversely spaced lands or partition walls 37, between which are formed insert slots 38. The insert slots 38 are uniformly transversely spaced at a gauge which is a multiple of the needle gauge, or twice the needle gauge as disclosed in the drawings. The insert slots 38 are disposed in parallel vertical planes so that the insert slots 38 extend from front-to-rear completely through the gauge member 35 and open through the bottom portion of the gauge member 35.

The front-to-rear dimension of the gauge member 35 is disclosed in the drawings as being approximately equal to the front-to-rear dimension of the recess 30. The height of the gauge member 35 is slightly less than the height of the recess 30. The height of the gauge member 35, as well as the height of the recess 30, is substantially less than the height of the hook bar 20, so that the major portion of the hook bar 20 is of solid material and lends substantial strength and stability to the retention of looper hooks 40 and 40' within the hook bar 20.

Each looper hook 40 has a body portion including a substantially elongated, relatively straight, rearward projecting shank or shank portion 41 adapted to fit within the major portion of the corresponding insert slot 30. The neck or head 42 of the looper hook 40 forming a part of the body portion, defines a rear vertical surface or shoulder 43 which intersects the shank portion 41. Projecting forward from the neck or head 42 of the looper hook 40 is an elongated bill 44, having a barbed free end portion 45, defining a bottom cutting edge 46 intersecting the throat 47.

The width of each insert slot 38 is great enough to receive a pair of hook shank portions 41 and 41' in spaced apart relationship within the corresponding insert slot 38.

To retain the shank portions 41 and 41' within the corresponding insert slot 38, a clamp member 50, preferably having a T-shaped cross-section and comprises an elongated divider member 51 and an enlarged head or bearing flange 52 projecting from opposite sides of one edge portion of the divider member 51, as best disclosed in FIGS. 3 and 4. The portions of the bearing flange 52 projecting beyond the side faces of the divider member 51 constitute seats 53 for supporting the shank portions 41 and 41' of the respective hooks 40 and 40'. The width or thickness of the divider member 51 approximately equals the space between the shank portion 41 and 40' when received within the slot 38. In other words, the sum of the thicknesses of the hook shank portions 41 and 41' and the thickness of the divider member 51 is substantially equal to the width of the corresponding insert slot 38.

Furthermore, as best disclosed in FIG. 1, the sum of the thickness of the top wall 36 of the gauge member 35, the height of the shank portion 41 and the height of the clamp head 52 are slightly less than the height of the elongated recess 30.

Arranged in the same vertical longitudinal plane of each insert slot 38 is a threaded hole 54 extending at an upward and rearward angle through the outer surface 26 and the solid material of the hook bar 20, opening into the recess 30. A set screw 55 is threaded through the threaded opening 54 until its operative or upper end 56 engages the vertically aligned head 52 of the T-clamp member 50, when assembled with a pair of hooks 40 and 40' within a corresponding insert slot 38, as best disclosed in FIG. 3. Thus, when the screw 55 is tightened, as disclosed in FIG. 1, the engagement of the bearing end 56 of the set screw 55 against the flange or clamp head 52 forces the clamp head 52 against the lower surfaces of the shank portions 41 and 41' to force them upward into their corresponding insert slot 38. The upper edges of the shank portions 41 and 41' engage the lower surfaces of the top wall 36 of the gauge member 35. Thus, the shank portions 41 are firmly secured within their corresponding slots 30 of the hook bar 20.

Formed on the upper front face 25 of the hook bar 20 above the recess 30 are a plurality of transversely spaced stiffener slots 58, including a plurality of transversely spaced lands 59 projecting forward from the face surface 60. The slots 58 are vertically aligned with the corresponding hooks 40 and 40' when clamped in the respective insert slots 38. Thus, when each looper hook 40 and 40' is received within the corresponding insert slot 38, each hook head or neck 42 fits within a corresponding stiffener slot 58, bearing against the face surface 60 between an opposing pair of lands 59. The stiffener slots 58 provide additional reinforcement for stabilizing the neck portions 42 of the hooks 40 and 40'.

In a preferred form of the invention, that is, in a staggered needle cut pile tufting machine, the looper hooks 40 cooperating with the rear needles 12 are identical in construction to the looper hooks 40' which cooperate with the front needles 11, except that the bills 44' of the looper hooks 40' are longer than the bills 44 by a length substantially equal to the offset longitudinal spacing between the rows of front needles 11 and rear needles 12. In the preferred form of the invention, the throats 47 of all of the loopers 40 and 40' are in transverse alignment, pursuant to the teaching in the U.S. Pat. No. 4,003,321, for "CUT PILE APPARATUS FOR STAGGERED NEEDLE TUFTING MACHINE".

Cooperating with each of the looper hooks 40 and 40' is a conventional cut pile knife 62 (FIG. 1) which is adapted to be reciprocated in a conventional manner in synchronism with the reciprocation of the hook bar 20 for cooperation with the respective needles 11 and 12 to catch and cut the yarns 14 and 15 in order to form cut pile loops, not shown.

The modular hook bars 20 are preferably made in sections abutting end-to-end, and the abutting ends overlap a corresponding bracket 22.

For ease of assembly, and to maintain the uniform hook slot gauge, each hook bar 20 may have mating, overlapping and recessed end portions, as indicated by the line 64 in FIG. 1.

Referring now to the modification disclosed in FIGS. 5–9, FIG. 5 discloses a cross-section of a needle bar assembly 70 made in accordance with this invention assembled in conventional multiple-needle tufting machines. The needle bar assembly 70 supports a plurality of uniformly spaced needles 71 in transverse alignment. It will be understood that the needle bar assembly 70 could support needles staggered in two rows and offset from each other, as disclosed in FIG. 1, if desired.

The needle bar assembly 70 is vertically reciprocated by conventional needle drive means, including a push rod 73 connected to the needle bar assembly 70. The push rod 73 vertically reciprocates the needle bar assembly 70 to cause the needles 71 to move between an upper position above the base fabric 75 (not shown) to a lower position (FIG. 5) penetrating the base fabric 75, so that the needles 71 will carry yarn 72 through the base fabric 75 to form loops of tufting therein, not shown. The base fabric 75 is supported upon a needle plate 76, for movement, by means, not shown, in the direction of the arrow of FIG. 5, that is longitudinal from front-to-rear of the machine.

The looper apparatus 76 which cooperates with the needle 71 may be identical to that disclosed in FIGS. 1–4, or may be of any other conventional construction, and includes the looper hooks 78. Where cut pile is formed by the needles 71 and the corresponding looper hooks 78, a knife 80 is reciprocably supported to cooperate with each hook 78 for cutting the seized loops, in a well-known manner.

The needle bar assembly 70 includes a continuous, elongated needle bar 82, having a front outside surface 83 and a bottom face surface 84. Formed co-extensively within the needle bar 82 and opening through the bottom face 84 is an elongated recess 85, preferably rectangular in cross-section, so that the needle bar 82 has a substantially inverted U-shaped cross-section.

The elongated recess 85 includes a top inner surface 86, a rear inner surface 87, and a front inner surface 88.

Adapted to be received within the recess 85 is an elongated gauge member 90 having an elongated continuous head member or head wall 91 from which project, parallel to each other, a plurality of uniformly longitudinally spaced lands or partition walls 92, defining insert slots 93.

Adapted to be received within each of the insert slots 93 is a clamp member 95, also having a T-shaped cross-section similar to each of the clamp members 50. Each clamp member 95 is provided with an elongated divider member 51, terminating in a head or bearing flange 52 which projects beyond both sides of one edge of the divider member 51 to form needle seats 98.

The width of each insert slot 93 is great enough to receive the thickness of the divider member 96 and the combined thicknesses of the shanks 100, preferably flattened, of the needles 71. As disclosed in the drawings, a pair of needles 71 are received in each insert slot 93 together with one clamp member 95.

The distance between the closed end 101 of each insert slot 93 and the front inner face 88 of the recess 85 is slightly greater than the width, or front-to-rear dimension of a needle shank 100 and the thickness, or front-to-rear dimension, of a corresponding clamp head 96.

Formed in the front face 83 of the needle bar 82 are a plurality of threaded set screw holes 102. There is one set screw hole 102 for each insert slot 93, each set screw hole 102 being in the same vertical plane as the center line of each of the insert slots 93. As disclosed in FIGS. 6 and 9, the threaded holes 102 may be staggered, if desired, although they may also be in longitudinal alignment.

Each set screw hole 102 is adapted to threadedly receive a set screw 104, which is adapted to extend from the front exterior surface 83 through the needle bar 82 and into the recess 85 to engage a bearing surface of a corresponding clamp head 96.

Thus, as each set screw 104 is tightened in its corresponding hole 102, it engages and presses the head 96 of the clamp member 95 rearward causing the seats 98 to bear against the front surfaces of the corresponding needle shanks 100 and force them rearward into the corresponding insert slot 93 until the rear edges of the needle shanks 100 are forced against the corresponding surface 101 of the slot 93. This pressure by the clamp member 95 is transmitted through the gauge member 90 and against the rear inner surface 87 of the recess 85. In this manner, the needles 71 are securely locked or fixed within the needle bar 82.

Furthermore, since only one set screw 104 is needed for each clamp member 95, and each clamp member 95 clamps two needles 71, only half as many set screws 104 are required in comparison with conventional needle bar assemblies.

Accordingly, because of the reduced number of set screws 104 and the reduced number of insert slots 93, the needles 71 may be spaced closer together to provide a very fine needle gauge.

For the same reasons, because of the reduced number of set screws 55 in the apparatus disclosed in FIGS. 1–4, and the reduced number of insert slots 38, the hooks 40 and knives 62 may be spaced closer together to provide more narrow needle gauges than have heretofore been successfully used in multiple needle tufting machines.

By virtue of the utilization of the gauge members 35 and 90. and the clamp members 50 and 95 the corresponding set screws 55 and 104 will engage only the relatively broad clamp heads 52 and 96 respectively, and engage no part of the respective tufting element, that is the hook shank 41 or the needle shank 100.

In the prior use of set screws, the ends of the set screws normally cut into the respective hook or needle shank to deface the respective tufting element or form burrs therein. With the above clamp members 50 and 95, there is broader bearing engagement between the clamp members 50 and 95 and their respective hooks 41 and needle shanks 100, thereby providing greater pressure distribution between the clamping force and the respective tufting element. Such a feature not only reduces the possible defacement or damage to the respective tufting element, but also provides a more secure gripping action between the respective hooks and needles and their respective hook bars and needle bars.

In prior hook bars which are generally made in elongated sections, which overlap each other as disclosed in FIGS. 1 and 4, crowding of the set screw holes 54 tends to weaken the walls of the set screw holes, particularly at the ends of the hook bar sections, thus, creating a definite limitation upon the spacing of the set screw holes 54 and therefore the fineness of the needle gauge. This problem is overcome by the reduced number of screw holes 54 in the hook bar 20.

With the utilization of the clamp members 50 and 95 in the respective looper and needle bar assemblies, needle gauges have been obtained as fine as 1/16 of an inch.

What is claimed is:

1. In a narrow gauge, multiple-needle tufting machine having a plurality of cooperative reciprocable tufting elements, including needles and looper hooks, for producing a tufted pile fabric, a clamping apparatus for a plurality of tufting elements, comprising:

(a) an elongated bar having a longitudinal dimension, a transverse dimension, a depthwise dimension, an elongated outer face and an elongated outer surface disposed at an angle to said outer face, (b) an elongated recess extending longitudinally within said bar, opening through said face, and spaced from said outer surface, (c) said recess having depthwise spaced first and second opposed inner surfaces, said second inner surface being closer to said outer surface than said first inner surface, (d) an elongated gauge member comprising an elongated bearing wall and a plurality of longitudinally spaced parallel partition walls projecting away from said bearing wall and defining gauge slots between said partition walls, (e) a clamp member having an elongated divider member of predetermined thickness adapted to be received within a gauge slot, and a clamp head projecting from both sides of said divider member to form opposite interior clamp seats and an exterior bearing surface, (f) said gauge member being received within said elongated recess with said bearing wall opposing said first inner surface, in assembled position, (g) said clamp member being received within said elongated recess with said divider member inserted in a corresponding gauge slot and spaced between a pair of opposed partition walls to receive a pair of tufting elements within said gauge slot on opposite sides of said divider member, in assembled position, and (h) set screw means projecting through said elongated outer surface of said elongated bar and said second inner surface into said recess for engaging said exterior bearing surface of said clamp member to force said clamp member into a corresponding gauge slot to clamp tufting elements within said gauge member, in assembled position.

2. The invention according to claim 1 in which the depthwise dimension of said gauge member is slightly less than the depthwise dimension of said elongated recess.

3. The invention according to claim 2 in which the depthwise dimensions of said gauge member and said clamp head are slightly less than the depthwise dimension of said elongated recess.

4. The invention according to claim 1 in which the depthwise distance of said bearing wall from said second interior surface is greater than the combined depth of said clamp head and the depthwise dimension of the portion of the tufting element received in said corresponding gauge slot.

5. The invention according to claim 1 in which said elongated bar is a hook bar and the tufting element received in said gauge slot is a looper hook having a shank portion adapted to project through said face into said gauge slot and adapted to rest on one of said clamp seats, and said shank being adapted to engage said bearing wall.

6. The invention according to claim 1 in which said elongated bar is a needle bar, said outer face comprising the bottom face of said needle bar, and each tufting element received in said corresponding gauge slot comprises a needle, each needle being adapted to engage said bearing wall and said clamp seat in assembled position.

7. The invention according to claim 1 in which said clamp member has a T-shaped cross-section and has a length substantially co-extensive with each gauge slot.

8. The invention according to claim 1 in which said partition walls are uniformly spaced apart to form gauge slots each gauge slot being adapted to receive a pair of tufting elements, the spacing of said partition walls being equal to twice the needle gauge of the tufting machine incorporating said clamping apparatus.

9. The invention according to claim 1 in which said set screw means comprises a set screw for each clamp member, a threaded hole for each set screw extending through said elongated bar from said outer surface through said second interior surface of said recess, each threaded hole being in substantially the same plane as a corresponding clamp head in assembled position, so that a set screw threaded through each corresponding hole may be adjusted to bear against said corresponding clamp head for clamping the corresponding tufting elements within said corresponding gauge slot.

* * * * *